US005830845A

United States Patent [19]

Trinh et al.

[11] Patent Number: 5,830,845

[45] Date of Patent: Nov. 3, 1998

[54] CONCENTRATED FABRIC SOFTENING COMPOSITION WITH GOOD FREEZE/THAW RECOVERY AND HIGHLY UNSATURATED FABRIC SOFTENER COMPOUND THEREFOR

[75] Inventors: Toan Trinh, Maineville; George Joseph Harvey, Fairfield; Helen Bernardo Tordil, West Chester; Errol Hoffman Wahl, Cincinnati, all of Ohio

[73] Assignee: The Procter & Gamble Company, Cincinnati, Ohio

[21] Appl. No.: 620,515

[22] Filed: Mar. 22, 1996

[51] Int. Cl.[6] ..... C11D 1/62; C11D 1/645

[52] U.S. Cl. ..... 510/504; 510/276; 510/329; 510/330; 510/515; 510/517; 510/521; 510/527; 510/522; 510/524; 510/525; 510/526

[58] Field of Search ..... 510/276, 329, 510/330, 504, 515, 517, 521, 527, 522, 524, 525, 526

[56] References Cited

U.S. PATENT DOCUMENTS

| | | | |
|---|---|---|---|
| 4,137,180 | 1/1979 | Naik et al. | 252/8.8 |
| 4,767,547 | 8/1988 | Straathoff et al. | 252/8.8 |
| 4,769,172 | 9/1988 | Siklosi | 252/153 |
| 4,789,491 | 12/1988 | Chang et al. | 252/8.75 |
| 5,133,885 | 7/1992 | Contor et al. | 252/8.6 |
| 5,460,736 | 10/1995 | Trinh et al. | 252/8.8 |
| 5,545,340 | 8/1996 | Wahl et al. | 510/517 |

*Primary Examiner*—Paul Lieberman
*Assistant Examiner*—Charles Boyer
*Attorney, Agent, or Firm*—Robert A. Aylor

[57] ABSTRACT

Biodegradable fabric softener compounds that contain ester linkages a substantial level of polyunsaturation in the hydrophobic chains. The compounds can be used to form fabric softening compositions that are aqueous dispersions of the compounds. These compositions have a desirable low viscosity and recover, after freezing and thawing to have a stable low viscosity.

9 Claims, No Drawings

CONCENTRATED FABRIC SOFTENING COMPOSITION WITH GOOD FREEZE/THAW RECOVERY AND HIGHLY UNSATURATED FABRIC SOFTENER COMPOUND THEREFOR

TECHNICAL FIELD

The present invention relates to highly-unsaturated, biodegradable fabric softener compounds for use in preparing softening compositions useful for softening cloth. It especially relates the preparation of concentrated textile softening compositions with good freeze/thaw recovery properties for use in the rinse cycle of a home textile laundering operation to provide excellent fabric-softening/static-control and rewet benefits.

BACKGROUND OF THE INVENTION

Fabric softening compositions containing high softener levels are known in the art. However, there is a need for highly concentrated compositions that have good freeze/thaw recovery properties, especially compositions that can be prepared by processing at normal ambient temperatures.

The present invention provides highly concentrated aqueous liquid textile treatment compositions, that have improved stability (i.e., do not precipitate, gel, thicken, or solidify) at normal, i.e., room temperatures and sub-normal temperatures under prolonged storage conditions and that will recover after freezing to form stable compositions.

SUMMARY OF THE INVENTION

The liquid fabric softener compositions herein comprise:

A. from about 15% to about 50%, preferably from about 16% to about 35%, more preferably from about 17% to about 30%, by weight of the composition, of biodegradable fabric softener active selected from the group consisting of:

1. softener having the formula:

$$[(R)_{4-m}-N^{(+)}-[(CH_2)_n-Y-R^1]_m]X^{(-)} \quad (1)$$

wherein each R substituent is a short chain $C_1$–$C_6$, preferably $C_1$–$C_3$ alkyl or hydroxyalkyl group, e.g., methyl (most preferred), ethyl, propyl, hydroxyethyl, and the like, benzyl, or mixtures thereof, each m is 2 or 3; each n is from 1 to about 4; each Y is —O—(O)C—, or —C(O)—O—; the sum of carbons in each $R^1$, plus one when Y is —O—(O)C—, is $C_{12}$–$C_{22}$, preferably $C_{14}$–$C_{20}$, with each $R^1$ being a hydrocarbyl, or substituted hydrocarbyl, group, preferably, alkyl, monounsaturated alkylene, and polyunsaturated alkylene groups, with the softener active containing polyunsaturated alkylene groups being at least about 3%, preferably at least about 5%, more preferably at least about 10%, and even more preferably at least about 15%, by weight of the total softener active present (As used herein, the "percent of softener active" containing a given $R^1$ group is the same as the percentage of that same $R^1$ group is to the total $R^1$ groups used to form all of the softener actives.); (As used herein, the Iodine Value of a "parent" fatty acid, or "corresponding" fatty acid, is used to define a level of unsaturation for an $R^1$ group that is the same as the level of unsaturation that would be present in a fatty acid containing the same $R^1$ group.); and wherein the counterion, X–, can be any softener-compatible anion, preferably, chloride, bromide, methyl sulfate, or nitrate, more preferably chloride;

2. softener having the formula:

(2)

wherein each Y, R, $R^1$, and $X(^-)$ have the same meanings as before (Such compounds include those having the formula:

$$[CH_3]_3N^{(+)}[CH_2CH(CH_2OC[O]R^1)OC(O)R^1]Cl^{(-)}$$

especially where $C(O)R^1$ is derived from mixtures of $R^1$ groups, containing some saturated, some unsaturated, e.g., oleic, fatty acid, and some polyunsaturated fatty acid, and, preferably, each R is a methyl or ethyl group and preferably each $R^1$ is in the range of $C_{15}$ to $C_{19}$ with varying degrees of unsaturation being present in the alkyl chains); and 3. mixtures thereof; said fabric softener active being in the form of a stable dispersion;

B. optionally, from 0% to about 10%, preferably from about 0.1% to about 5%, and more preferably from about 0.2% to about 3%, of perfume;

C. optionally, rom 0% to about 2%, preferably from about 0.01% to about 0.2%, and more preferably from about 0.035% to about 0.1%, of stabilizer; and D. the balance being a liquid carrier comprising water and, optionally, from about 5% to about 30%, preferably from about 8% to about 25%, more preferably from about 10% to about 20%, by weight of the composition of water soluble organic solvent; the viscosity of the composition being less than about 500 cps, preferably less than about 400 cps, more preferably less than about 200 cps, and recovering to less than about 1000 cps, preferably less than about 500 cps, more preferably less than about 200 cps after freezing and thawing.

The pH of the compositions should be from about 1 to about 5, preferably from about 1.5 to about 4.5, more preferably from about 2 to about 3.5.

DETAILED DESCRIPTION OF THE INVENTION

A. FABRIC SOFTENING ACTIVE

The essential component herein is, from about 15% to about 50%, preferably from about 16% to about 35%, more preferably from about 17% to about 30%, by weight of the composition, of a biodegradable fabric softener active selected from the compounds identified hereinafter, and mixtures thereof These compounds are novel compounds having unobvious properties when formulated into aqueous, concentrated fabric softener compositions of the traditional type that are dispersions/suspensions of fabric softener actives. The compounds should have at least about 3%, more preferably at least about 5%, even more preferably at least about 10%, and still more preferably at least about 15% of softener active containing polyunsaturated groups. This polyunsaturation provides superior freeze/thaw recovery. Normally, one would not want polyunsaturated groups in actives, since they tend to be much more unstable than even monounsaturated groups. The presence of these highly unsaturated materials makes it highly desirable, and for the higher levels of polyunsaturation, essential, that the compounds and/or compositions herein contain antibacterial agents, antioxidants, and/or reducing materials, to protect the actives from degradation.

Diester Quaternary Ammonium Fabric Softening Active Compound (DEQA)

(1) The first type of DEQA preferably comprises, as the principal active, compounds of the formula $$[(R)_{4-m}-N^{(+)}-[(CH_2)_n-Y-R^1]_m]X^{(-)} \quad (1)$$

wherein each R substituent is a short chain $C_1$–$C_6$, preferably $C_1$–$C_3$ alkyl or hydroxyalkyl group, e.g., methyl (most preferred), ethyl, propyl, hydroxyethyl, and the like, benzyl or mixtures thereof; each m is 2 or 3; each n is from 1 to about 4; each Y is —O—(O)C—, or —C(O)—O—; the sum of carbons in each $R^1$, plus one when Y is —O—(O)C—, is $C_{12}$–$C_{22}$, preferably $C_{14}$–$C_{20}$, with each $R^1$ being a hydrocarbyl, or substituted hydrocarbyl group. Preferably, the softener active contains alkyl, monounsaturated alkylene, and polyunsaturated alkylene groups, with the softener active containing polyunsaturated alkylene groups being at least about 3%, preferably at least about 5%, more preferably at least about 10%, and even more preferably at least about 15%, by weight of the total softener active present. (As used herein, the "percent of softener active" containing a given $R^1$ group is based upon taking a percentage of the total active based upon the percentage that the given $R^1$ group is, of the total $R^1$ groups present.)

The Iodine Value (hereinafter referred to as IV) of the parent fatty acids of these $R^1$ group is preferably from about 60 to about 140, more preferably from about 70 to about 130; and even more preferably from about 75 to about 115, on the average. It is believed that the actives which comprise unsaturated $R^1$ groups are preferably from about 50% to about 100%, more preferably from about 55% to about 95%, and even more preferably from about 60% to about 90%, by weight of the total active present. The actives containing polyunsaturated $R^1$ groups are at least about 3%, preferably at least about 5%, and more preferably at least about 10%, and yet more preferably at least about 15%, by weight, of the total actives present. These polyunsaturated groups are necessary to provide optimum viscosity stability, especially after freezing and thawing. The higher the level of polyunsaturated $R^1$ groups in the actives, the lower the level of actives which comprise unsaturated $R^1$ groups can be.

The counterion, $X(^-)$ above, can be any softener-compatible anion, preferably the anion of a strong acid, for example, chloride, bromide, methylsulfate, sulfate, nitrate and the like, and more preferably chloride.

These biodegradable quaternary ammonium fabric softening compounds preferably contain the group $C(O)R^1$ which is derived, primarily from unsaturated fatty acids, e.g., oleic acid, the essential polyunsaturated fatty acids, and/or saturated fatty acids, and/or partially hydrogenated fatty acids from natural sources, e.g., derived from vegetable oils and/or partially hydrogenated vegetable oils, such as, canola oil, safflower oil, peanut oil, sunflower oil, corn oil, soybean oil, tall oil, rice bran oil, etc. In other preferred embodiments, the fatty acids have the following approximate distributions, the comparative DEQAs being similar to those described in the art:

| Fatty Acyl Group | DEQA[1] | DEQA[2] | DEQA[3] | DEQA[4] | DEQA[5] |
|---|---|---|---|---|---|
| C12 | trace | trace | 0 | 0 | 0 |
| C14 | 3 | 3 | 0 | 0 | 0 |
| C16 | 4 | 4 | 5 | 5 | 5 |
| C18 | 0 | 0 | 5 | 6 | 6 |
| C14:1 | 3 | 3 | 0 | 0 | 0 |
| C16:1 | 11 | 7 | 0 | 0 | 3 |
| C18:1 | 74 | 73 | 71 | 68 | 67 |
| C18:2 | 4 | 8 | 8 | 11 | 11 |
| C18:3 | 0 | 1 | 1 | 2 | 2 |
| C20:1 | 0 | 0 | 2 | 2 | 2 |
| C20 and up | 0 | 0 | 2 | 0 | 0 |

-continued

| Fatty Acyl Group | DEQA[1] | DEQA[2] | DEQA[3] | DEQA[4] | DEQA[5] |
|---|---|---|---|---|---|
| Unknowns | 0 | 0 | 6 | 6 | 7 |
| Total | 99 | 99 | 100 | 100 | 102 |
| IV | 86–90 | 88–95 | 99 | 100 | 95 |
| cis/trans (C18:1) | 20–30 | 20–30 | 4 | 5 | 5 |
| TPU | 4 | 9 | 10 | 13 | 13 |

Nonlimiting examples of DEQA's are as follows:

| Fatty Acyl Group | DEQA[10] | DEQA[11] |
|---|---|---|
| C14 | 0 | 1 |
| C16 | 11 | 25 |
| C18 | 4 | 20 |
| C14:1 | 0 | 0 |
| C16:1 | 1 | 0 |
| C18:1 | 27 | 45 |
| C18:2 | 50 | 6 |
| C18:3 | 7 | 0 |
| Unknowns | 0 | 3 |
| Total | 100 | 100 |
| IV | 125–138 | 56 |
| cis/trans (C18:1) | Not Available | 7 |
| TPU | 57 | 6 |

$DEQA^{10}$ is prepared from a soy bean fatty acid, and $DEQA^{11}$ is prepared from a slightly hydrogenated tallow fatty acid.

It is preferred that at least a majority of the fatty acyl groups are unsaturated, e.g., from about 50% to 100%, preferably from about 55% to about 95%, more preferably from about 60% to about 90%, and that the total level of active containing polyunsaturated fatty acyl groups (TPU) be from about 3% to about 30%, preferably from about 5% to about 25%, more preferably from about 10% to about 18%. The cis/trans ratio for the unsaturated fatty acyl groups is important, with a cis/trans ratio of from 1:1 to about 50:1, the minimum being 1:1, preferably at least 3:1, and more preferably from about 4:1 to about 20:1.

The unsaturated, including the essential polyunsaturated, fatty acyl groups surprisingly provide effective softening, but also provide better rewetting characteristics, good antistatic characteristics, and superior recovery after freezing and thawing.

The highly unsaturated materials are also easier to formulate into concentrated premixes that maintain their low viscosity and are therefore easier to process, e.g., pump, mixing, etc. These highly unsaturated materials with only a low amount of solvent that normally is associated with such materials, i.e., from about 5% to about 20%, preferably from about 8% to about 25%, more preferably from about 10% to about 20%, weight of the total softener/solvent mixture, are also easier to formulate into concentrated, stable dispersion compositions of the present invention, even at ambient temperatures. This ability to process the actives at low temperatures is especially important for the polyunsaturated groups, since it mimimizes degradation. Additional protection against degradation can be provided when the compounds and softener compositions contain effective antioxidants and/or reducing agents, as disclosed hereinafter.

It will be understood that substituents R and $R^1$ can optionally be substituted with various groups such as alkoxyl or hydroxyl groups, so long as the $R^1$ groups maintain their basically hydrophobic character. The preferred compounds can be considered to be biodegradable diester variations of ditallow dimethyl ammonium chloride (hereinafter referred to as "DTDMAC"), which is a widely used fabric softener. A preferred long chain DEQA is the DEQA prepared from sources containing high levels of polyunsaturation, i.e., N,N-di(acyl-oxyethyl)-N,N-dimethyl ammonium chloride, where the acyl is derived from fatty acids containing sufficient polyunsaturation.

As used herein, when the diester is specified, it can include the monoester that is present. Preferably, at least about 80% of the DEQA is in the diester form, and from 0% to about 20% can be DEQA monoester (e.g., in formula (1), m is 2 and one $YR^1$ group is either "H" or "—C—(O)—OH"). For softening, under no/low detergent carry-over laundry conditions the percentage of monoester should be as low as possible, preferably no more than about 5%. However, under high, anionic detergent surfactant or detergent builder carry-over conditions, some monoester can be preferred. The overall ratios of diester to monoester are from about 100:1 to about 2:1, preferably from about 50:1 to about 5:1, more preferably from about 13:1 to about 8:1. Under high detergent carry-over conditions, the di/monoester ratio is preferably about 11:1. The level of monoester present can be controlled in manufacturing the DEQA.

The above compounds, used as the biodegradable quaternized ester-amine softening material in the practice of this invention, can be prepared using standard reaction chemistry. In one synthesis of a di-ester variation of DTDMAC, an amine of the formula $RN(CH_2CH_2OH)_2$ is esterified at both hydroxyl groups with an acid chloride of the formula $R^1C(O)Cl$, then quaternized with an alkyl halide, RX, to yield the desired reaction product (wherein R and $R^1$ are as defined hereinbefore). However, it will be appreciated by those skilled in the chemical arts that this reaction sequence allows a broad selection of agents to be prepared.

Yet another DEQA softener active that is suitable for the formulation of the concentrated, liquid fabric softener compositions of the present invention, has the above formula (1) wherein one R group is a $C_{1-4}$ hydroxy alkyl group, preferably one wherein one R group is a hydroxyethyl group. An example of such a hydroxyethyl ester active is di(acyloxyethyl)(2-hydroxyethyl)methyl ammonium methyl sulfate, where the acyl is derived from the fatty acids described hereinbefore. Another example of this type of DEQA is derived from the same fatty acid as that of $DEQA^1$, and is denoted hereinafter as $DEQA^8$.

(2) A second type of DEQA active has the general formula:

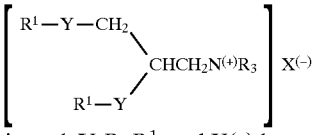

(2)

wherein each Y, R, $R^1$, and $X(^-)$ have the same meanings as before. Such compounds include those having the formula:

$$[CH_3]_3N^{(+)}[CH_2CH(CH_2OC[O]R^1)OC(O)R^1]Cl^{(-)}$$

where each R is a methyl or ethyl group and preferably each $R^1$ is in the range of $C_{15}$ to $C_{19}$. As used herein, when the diester is specified, it can include the monoester that is present. The amount of monoester that can be present is the same as in DEQA (1).

These types of agents and general methods of making them are disclosed in U.S. Pat. No. 4,137,180, Naik et al., issued Jan. 30, 1979, which is incorporated herein by reference. An example of a preferred DEQA of formula (2) is the "propyl" ester quaternary ammonium fabric softener active having the formula 1,2-di(acyloxy)-3-trimethylammoniopropane chloride, where the acyl is the same as that of $DEQA^5$, and is denoted hereinafter as $DEQA^9$.

The DEQA actives described hereinabove can contain a low level of the fatty acids which can be unreacted starting material and/or by-product of any partial degradation, e.g., hydrolysis, of the softener actives in the finished compositions. It is preferred that the level of free fatty acid be low, preferably below about 10%, more preferably below about 5%, by weight of the softener active.

CONCENTRATED DISPERSION COMPOSITIONS

Stable "dispersion" compositions which can be prepared using the novel compounds/compositions herein are those disclosed in copending U.S. patent application Ser. No. 08/461,207, filed Jun. 5, 1995, by E. H. Wahl et al., said application being incorporated herein by reference.

B. WATER SOLUBLE ORGANIC SOLVENT SYSTEM

The dispersion compositions of the present invention optionally comprise from about 5% to about 30%, preferably from about 8% to about 25%, more preferably from about 10% to about 20%, by weight of the composition of water soluble organic solvent. The solvent is preferably mixed with the fabric softener DEQA to help provide a low viscosity for ease of processing, e.g., pumping and/or mixing, even at ambient temperatures.

The organic solvent is preferably water soluble solvent, e.g., ethanol; isopropanol; 1,2-propanediol; 1,3-propanediol; propylene carbonate; etc.

The ability to create finished concentrated compositions with conventional mixing at ambient temperatures, e.g., from about 10° C. to about 40° C., preferably from about 20° C. to about 35° C., with only low levels of water soluble solvents, is possible with the highly unsaturated fabric softener compounds disclosed hereinbefore. This processing at ambient temperatures is very important when the dispersion compositions contain high levels of polyunsaturated softener active materials.

C. PERFUME

The premixes and/or finished compositions of the present invention can contain any softener compatible perfume. Preferred perfumes are disclosed in U.S. Pat. No. 5,500,138, Bacon et al., issued Mar. 19, 1996, said patent being incorporated herein by reference. Perfume is optionally present at a level of from about 0% to about 10%, preferably from about 0.1% to about 5%, more preferably from about 0.2% to about 3%, by weight of the finished composition. It is an advantage of the use of this invention, that the perfume preferably can be added in the premix to simplify the preparation of the finished dispersion compositions and to improve fabric deposition of said perfume. The premix can be added to water containing the requisite amount of acid, preferably mineral acid, more preferably HCl, to create the finished composition as discussed hereinafter.

D. STABILIZERS

Stabilizers are highly desirable, and even essential, in the finished dispersion compositions, and, optionally, the raw materials, of the present invention. The term "stabilizer," as used herein, includes antioxidants and reductive agents. These agents are present at a level of from 0% to about 2%, preferably from about 0.01% to about 0.2%, more preferably from about 0.035% to about 0.1% for antioxidants, and more preferably from about 0.01% to about 0.2% for reductive agents, in the final composition. For the premix, the levels are adjusted, depending on the concentrations of the softener active in the premix and the finished composition. These assure good odor stability under long term storage conditions. Antioxidants and reductive agent stabilizers are especially critical for unscented or low scent products (no or low perfume).

Examples of antioxidants that can be added to the dispersion compositions of this invention include a mixture of ascorbic acid, ascorbic palmitate, propyl gallate, available from Eastman Chemical Products, Inc., under the trade names Tenox® PG and Tenox® S-1; a mixture of BHT (butylated hydroxytoluene), BHA (butylated hydroxyanisole), propyl gallate, and citric acid, available from Eastman Chemical Products, Inc., under the trade name Tenox®-6; butylated hydroxytoluene, available from UOP Process Division under the trade name Sustane® BHT; tertiary butylhydroquinone, Eastman Chemical Products, Inc., as Tenox® TBHQ; natural tocopherols, Eastman Chemical Products, Inc., as Tenox® GT-1/GT-2; and butylated hydroxyanisole, Eastman Chemical Products, Inc., as BHA; long chain esters ($C_8$–$C_{22}$) of gallic acid, e.g., dodecyl gallate; Irganox® 1010; Irganox® 1035; Irganox® B 1171; Irganox® 1425; Irganox® 3114; Irganox® 3125; and mixtures thereof; preferably Irganox® 3125, Irganox® 1425, Irganox® 3114, and mixtures thereof; more preferably Irganox® 3125 alone or mixed with citric acid and/or other chelators such as isopropyl citrate, Dequest® 2010, available from Monsanto with a chemical name of 1-hydroxyethylidene-1,1-diphosphonic acid (etidronic acid), and Tiron®, available from Kodak with a chemical name of 4,5-dihydroxy-m-benzene-sulfonic acid/sodium salt, and DTPA®, available from Aldrich with a chemical name of diethylenetriaminepentaacetic acid.

E. OPTIONAL INGREDIENTS (A) Brighteners

The premix, and especially the finished dispersion compositions herein can also optionally contain from about 0.005% to 5% by weight of certain types of hydrophilic optical brighteners which also provide a dye transfer inhibition action. If used, the dispersion compositions herein will preferably comprise from about 0.001% to 1% by weight of such optical brighteners.

The hydrophilic optical brighteners useful in the present invention are those having the structural formula:

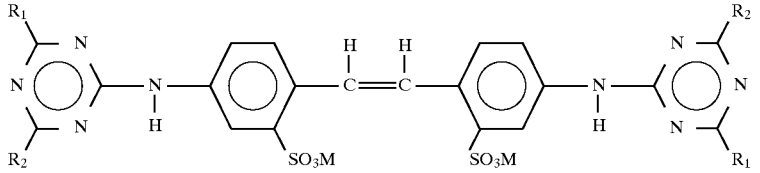

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX® by Ciba-Geigy Corporation. Tinopal-UNPA-GX is the preferred hydrophilic optical brightener useful in the rinse added dispersion compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX® by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX® by Ciba Geigy Corporation.

(B) Dispersibility Aids

The dispersion compositions of the present invention can optionally contain dispersibility aids, e.g., those selected from the group consisting of mono-long chain alkyl cationic quaternary ammonium compounds, mono-long chain alkyl amine oxides, and mixtures thereof, to assist in the formation of the finished dispersion compositions. When said dispersibility aid is present, it is typically present at a total level of from about 2% to about 25%, preferably from about 3% to about 17%, more preferably from about 4% to about 15%, and even more preferably from 5% to about 13% by weight of the composition. These materials can either be added as part of the active softener raw material, (I), or added as a separate component. The total level of dispersibility aid includes any amount that may be present as part of component (I).

(1) Mono-Alkyl Cationic Quaternary Ammonium Compound

When the mono-alkyl cationic quaternary ammonium compound is present, it is typically present at a level of from about 2% to about 25%, preferably from about 3% to about 17%, more preferably from about 4% to about 15%, and even more preferably from 5% to about 13% by weight of the composition, the total mono-alkyl cationic quaternary ammonium compound being at least at an effective level.

Such mono-alkyl cationic quaternary ammonium compounds useful in the present invention are, preferably, quaternary ammonium salts of the general formula:

$$[R^4N^+(R^5)_3]X^-$$

wherein $R^4$ is $C_8$–$C_{22}$ alkyl or alkenyl group, preferably $C_{10}$–$C_{18}$ alkyl or alkenyl group; more preferably $C_{10}$–$C_{14}$ or $C_{16}$–$C_{18}$ alkyl or alkenyl group; each $R^5$ is a $C_1$–$C_6$ alkyl or substituted alkyl group (e.g., hydroxy alkyl), preferably $C_1$–$C_3$ alkyl group, e.g., methyl (most preferred), ethyl, propyl, and the like, a benzyl group, hydrogen, a polyethoxylated chain with from about 2 to about 20 oxyethylene units, preferably from about 2.5 to about 13 oxyethylene units, more preferably from about 3 to about 10 oxyethylene units, and mixtures thereof; and $X^-$is as defined hereinbefore for (Formula (I)).

Especially preferred dispersibility aids are monolauryl trimethyl ammonium chloride and monotallow trimethyl ammonium chloride available from Witco under the trade name Varisoft® 471 and monooleyl trimethyl ammonium chloride available from Witco under the tradename Varisoft® 417.

The $R^4$ group can also be attached to the cationic nitrogen atom through a group containing one, or more, ester, amide, ether, amine, etc., linking groups which can be desirable for increased concentratability of component (I), etc. Such linking groups are preferably within from about one to about three carbon atoms of the nitrogen atom.

Mono-alkyl cationic quaternary ammonium compounds also include $C_8$–$C_{22}$ alkyl choline esters. The preferred dispersibility aids of this type have the formula:

$$R^1C(O)—O—CH_2CH_2N^+(R)_3X^-$$

wherein $R^1$, R and $X^-$are as defined previously.

Highly preferred dispersibility aids include $C_{12}$–$C_{14}$ coco choline ester and $C_{16}$–$C_{18}$ tallow choline ester.

Suitable biodegradable single-long-chain alkyl dispersibility aids containing an ester linkage in the long chains are described in U.S. Pat. No. 4,840,738, Hardy and Walley, issued Jun. 20, 1989, said patent being incorporated herein by reference.

When the dispersibility aid comprises alkyl choline esters, preferably the dispersion compositions also contain a small amount, preferably from about 2% to about 5% by weight of the composition, of organic acid. Organic acids are described in European Patent Application No. 404,471, Machin et al., published on Dec. 27, 1990, supra, which is herein incorporated by reference. Preferably the organic acid is selected from the group consisting of glycolic acid, acetic acid, citric acid, and mixtures thereof.

Ethoxylated quaternary ammonium compounds which can serve as the dispersibility aid include ethylbis (polyethoxy ethanol)alkylammonium ethyl-sulfate with 17 moles of ethylene oxide, available under the trade name Variquat® 66 from Sherex Chemical Company; polyethylene glycol (15) oleammonium chloride, available under the trade name Ethoquad® 0/25 from Akzo; and polyethylene glycol (15) cocomonium chloride, available under the trade name Ethoquad® C/25 from Akzo.

Although the main function of the dispersibility aid is to increase the dispersibility of the ester softener, preferably the dispersibility aids of the present invention also have some softening properties to boost softening performance of the composition. Therefore, preferably the dispersion compositions of the present invention are essentially free of non-nitrogenous ethoxylated nonionic dispersibility aids which will decrease the overall softening performance of the dispersion compositions.

Also, quaternary compounds having only a single long alkyl chain, can protect the cationic softener from interacting with anionic surfactants and/or detergent builders that are carried over into the rinse from the wash solution.

(2) Amine Oxides

Suitable amine oxides include those with one alkyl or hydroxyalkyl moiety of about 8 to about 22 carbon atoms, preferably from about 10 to about 18 carbon atoms, more preferably from about 8 to about 14 carbon atoms, and two alkyl moieties selected from the group consisting of alkyl groups and hydroxyalkyl groups with about 1 to about 3 carbon atoms.

Examples include dimethyloctylamine oxide, diethyldecylamine oxide, bis-(2-hydroxyethyl)dodecyl-amine oxide, dimethyldodecylamine oxide, dipropyl-tetradecylamine oxide, methylethylhexadecylamine oxide, dimethyl-2-hydroxyoctadecylamine oxide, and coconut fatty alkyl dimethylamine oxide.

(C) Soil Release Agent

In the present invention, an optional soil release agent can be added, especially to the finished dispersion compositions. The addition of the soil release agent can occur in combination with the premix, in combination with the acid/water seat, before or after electrolyte addition, or after the final composition is made. The finished softening composition prepared by the process of the present invention herein can contain from 0% to about 10%, preferably from 0.2% to about 5%, of a soil release agent. The concentration in the premix is adjusted to provide the desired end concentration. Preferably, such a soil release agent is a polymer. Polymeric soil release agents useful in the present invention include copolymeric blocks of terephthalate and polyethylene oxide or polypropylene oxide, and the like.

A preferred soil release agent is a copolymer having blocks of terephthalate and polyethylene oxide. More specifically, these polymers are comprised of repeating units of ethylene terephthalate and polyethylene oxide terephthalate at a molar ratio of ethylene terephthalate units to polyethylene oxide terephthalate units of from 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon 4780® (from Dupont) and Milease T® (from ICI).

Highly preferred soil release agents are polymers of the generic formula:

$$X—(OCH_2CH_2)_p(O—\overset{O}{\overset{\|}{C}}—R^{14}—\overset{O}{\overset{\|}{C}}—OR^{15})_u(O—\overset{O}{\overset{\|}{C}}—R^{14}—\overset{O}{\overset{\|}{O}}C—O)(CH_2CH_2O)_n—X$$

in which each X can be a suitable capping group, with each X typically being selected from the group consisting of H, and alkyl or acyl groups containing from about 1 to about 4 carbon atoms. p is selected for water solubility and generally is from about 6 to about 113, preferably from about 20 to about 50. u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^{14}$ moieties are essentially 1,4-phenylene moieties. As used herein, the term "the $R^{14}$ moieties are essentially 1,4-phenylene moieties" refers to compounds where the $R^{14}$ moieties consist entirely of 1,4-phenylene moieties, or are partially substituted with other arylene or alkarylene moieties, alkylene moieties, alkenylene moieties, or mixtures thereof Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene, and mixtures thereof. Alkylene and alkenylene moieties which can be partially substituted include 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^{14}$ moieties, the degree of partial substitution with moieties other than 1,4-phenylene should be such that the soil release properties of the compound are not adversely affected to any great extent. Generally the degree of partial substitution which can be tolerated will depend upon the backbone length of the compound, i.e., longer backbones can have greater partial substitution for 1,4-phenylene moieties. Usually, compounds where the $R^{14}$ comprise from about 50% to about 100% 1,4-phenylene moieties (from 0% to about 50% moieties other than 1,4-phenylene) have adequate soil release activity. For example, polyesters made according to the present invention with a 40:60 mole ratio of isophthalic (1,3-phenylene) to terephthalic (1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $R^{14}$ moieties consist entirely of (i.e., comprise 100%) 1,4-phenylene moieties, i.e., each $R^{14}$ moiety is 1,4-phenylene.

For the $R^{15}$ moieties, suitable ethylene or substituted ethylene moieties include ethylene, 1,2-propylene, 1,2-butylene, 1,2-hexylene, 3-methoxy-1,2-propylene, and mixtures thereof Preferably, the $R^{15}$ moieties are essentially ethylene moieties, 1,2-propylene moieties, or mixtures thereof. Inclusion of a greater percentage of ethylene moieties tends to improve the soil release activity of compounds. Surprisingly, inclusion of a greater percentage of 1,2-propylene moieties tends to improve the water solubility of compounds.

Therefore, the use of 1,2-propylene moieties or a similar branched equivalent is desirable for incorporation of any substantial part of the soil release component in the liquid fabric softener dispersion compositions. Preferably, from about 75% to about 100%, are 1,2-propylene moieties.

The value for each p is at least about 6, and preferably is at least about 10. The value for each n usually ranges from about 12 to about 113. Typically the value for each p is in the range of from about 12 to about 43.

A more complete disclosure of soil release agents is contained in U.S. Pat. Nos. 4,661,267, Decker, Konig, Straathof, and Gosselink, issued Apr. 28, 1987; 4,711,730, Gosselink and Diehl, issued Dec. 8, 1987; 4,749,596, Evans, Huntington, Stewart, Wolf, and Zimmerer, issued June 7, 1988; 4,818,569, Trinh, Gosselink, and Rattinger, issued Apr. 4, 1989; 4,877,896, Maldonado, Trinh, and Gosselink, issued Oct. 31, 1989; 4,956,447, Gosselink et al., issues Sep. 11, 1990; and 4,976,879, Maldonado, Trinh, and Gosselink, issued Dec. 11, 1990, all of said patents being incorporated herein by reference.

These soil release agents can also act as scum dispersants.

(D) Scum Dispersant

In the present invention, the premix can be combined with an optional scum dispersant, other than the soil release agent, and heated to a temperature at or above the melting point(s) of the components. Scum dispersants are desirable components of the finished dispersion compositions herein.

The preferred scum dispersants herein are formed by highly ethoxylating hydrophobic materials. The hydrophobic material can be a fatty alcohol, fatty acid, fatty amine, fatty acid amide, amine oxide, quaternary ammonium compound, or the hydrophobic moieties used to form soil release polymers. The preferred scum dispersants are highly ethoxylated, e.g., more than about 17, preferably more than about 25, more preferably more than about 40, moles of ethylene oxide per molecule on the average, with the polyethylene oxide portion being from about 76% to about 97%, preferably from about 81% to about 94%, of the total molecular weight.

The level of scum dispersant is sufficient to keep the scum at an acceptable, preferably unnoticeable to the consumer, level under the conditions of use, but not enough to adversely affect softening. For some purposes it is desirable that the scum is nonexistent. Depending on the amount of anionic or nonionic detergent, etc., used in the wash cycle of a typical laundering process, the efficiency of the rinsing steps prior to the introduction of the dispersion compositions herein, and the water hardness, the amount of anionic or nonionic detergent surfactant and detergency builder (especially phosphates and zeolites) entrapped in the fabric (laundry) will vary. Normally, the minimum amount of scum dispersant should be used to avoid adversely affecting softening properties. Typically scum dispersion requires at least about 2%, preferably at least about 4% (at least 6% and preferably at least 10% for maximum scum avoidance) based upon the level of softener active. However, at levels of about 10% (relative to the softener material) or more, one risks loss of softening efficacy of the product especially when the fabrics contain high proportions of nonionic surfactant which has been absorbed during the washing operation.

Preferred scum dispersants are: Brij 700®; Varonic U-250®; Genapol T-500®, Genapol T-800®; Plurafac A-79®; and Neodol 25-50®.

(E) Bactericides

Examples of bactericides used in the premixes and/or finished dispersion compositions of this invention include glutaraldehyde, formaldehyde, 2-bromo-2-nitro-propane-1, 3-diol sold by Inolex Chemicals, located in Philadelphia, Pa., under the trade name Bronopol®, and a mixture of 5-chloro-2-methyl-4-isothiazoline-3-one and 2-methyl-4-isothiazoline-3-one sold by Rohm and Haas Company under the trade name Kathon CG/ICP®. Typical levels of bactericides used in the present dispersion compositions are from about 1 to about 1,000 ppm by weight of the agent.

(F) Chelating Agents

The finished dispersion compositions and processes herein can optionally employ one or more copper and/or nickel chelating agents ("chelators"). Such water-soluble chelating agents can be selected from the group consisting of amino carboxylates, amino phosphonates, polyfunctionally-substituted aromatic chelating agents and mixtures thereof, all as hereinafter defined. The whiteness and/or brightness of fabrics are substantially improved or restored by such chelating agents and the stability of the materials in the dispersion compositions are improved.

Amino carboxylates useful as chelating agents herein include ethylenediaminetetraacetates (EDTA), N-hydroxyethylethylenediaminetriacetates, nitrilotriacetates (NTA), ethylenediamine tetraproprionates, ethylenediamine-N,N'-diglutamates, 2-hyroxypropylenediamine-N,N'-disuccinates, triethylenetetraaminehexacetates, diethylenetriaminepentaacetates (DETPA), and ethanoldiglycines, including their water-soluble salts such as the alkali metal, ammonium, and substituted ammonium salts thereof and mixtures thereof.

Amino phosphonates are also suitable for use as chelating agents in the dispersion compositions of the invention when at least low levels of total phosphorus are permitted in detergent dispersion compositions, and include ethylenediaminetetrakis (methylenephosphonates), diethylenetriamine-N,N,N',N",N"-pentakis(methane phosphonate) (DETMP) and 1-hydroxyethane-1,1-diphosphonate (HEDP). Preferably, these amino phosphonates to not contain alkyl or alkenyl groups with more than about 6 carbon atoms.

The chelating agents are typically used in the present rinse process at levels from about 2 ppm to about 25 ppm, for periods from 1 minute up to several hours'soaking.

The preferred EDDS chelator used herein (also known as ethylenediamine-N,N'-disuccinate) is the material described in U.S. Pat. No. 4,704,233, cited hereinabove, and has the formula (shown in free acid form):

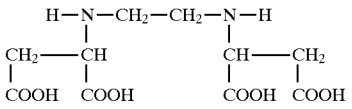

As disclosed in the patent, EDDS can be prepared using maleic anhydride and ethylenediamine. The preferred biodegradable [S,S] isomer of EDDS can be prepared by reacting L-aspartic acid with 1,2-dibromoethane. The EDDS has advantages over other chelators in that it is effective for chelating both copper and nickel cations, is available in a biodegradable form, and does not contain phosphorus. The EDDS employed herein as a chelator is typically in its salt form, i.e., wherein one or more of the four acidic hydrogens are replaced by a water-soluble cation M, such as sodium, potassium, ammonium, triethanolammonium, and the like. As noted before, the EDDS chelator is also typically used in the present rinse process at levels from about 2 ppm to about 25 ppm for periods from 1 minute up to several hours' soaking. At certain pH's the EDDS is preferably used in combination with zinc cations.

As can be seen from the foregoing, a wide variety of chelators can be used herein. Indeed, simple polycarboxylates such as citrate, oxydisuccinate, and the like, can also be used, although such chelators are not as effective as the amino carboxylates and phosphonates, on a weight basis. Accordingly, usage levels may be adjusted to take into account differing degrees of chelating effectiveness. The chelators herein will preferably have a stability constant (of the fully ionized chelator) for copper ions of at least about 5, preferably at least about 7. Typically, the chelators will comprise from about 0.5% to about 10%, more preferably from about 0.75% to about 5%, by weight of the dispersion compositions herein. Preferred chelators include DETMP, DETPA, NTA, EDDS and mixtures thereof.

(G) Optional Viscosity/Dispersibility Modifiers

Relatively concentrated finished dispersion compositions containing the unsaturated diester quaternary ammonium compounds herein can be prepared that are stable without the addition of concentration aids. However, the dispersion compositions of the present invention may require organic and/or inorganic concentration aids to go to even higher concentrations and/or to meet higher stability standards depending on the other ingredients. These concentration aids which typically can be viscosity modifiers may be needed, or preferred, for ensuring stability under extreme conditions when particular softener active levels are used. The surfactant concentration aids are typically selected from the group consisting of (1) single long chain alkyl cationic surfactants; (2) nonionic surfactants; (3) amine oxides; (4) fatty acids; and (5) mixtures thereof These aids are described in P&G Copending application Ser. No. 08/461,207, filed Jun. 5, 1995, Wahl et al., specifically on page 14, line 12 to page 20, line 12, which is herein incorporated by reference.

(H) Other Optional Ingredients

The finished dispersion compositions of the present invention can include optional components conventionally used in textile treatment dispersion compositions, for example: colorants; preservatives; surfactants; anti-shrinkage agents; fabric crisping agents; spotting agents; germicides; fungicides; anti-oxidants such as butylated hydroxy toluene, anti-corrosion agents, and the like.

Particularly preferred ingredients include water soluble calcium and/or magnesium compounds, which provide additional stability. The chloride salts are preferred, but acetate, nitrate, etc. salts can be used. The level of said calcium and/or magnesium salts is from 0% to about 2%, preferably from about 0.05% to about 0.5%, more preferably from about 0.1% to about 0.25%. These materials are desirably added to the water and/or acid (water seat) used to prepare the finished dispersion compositions to help adjust the finished viscosity.

The present invention can also include other compatible ingredients, including those as disclosed in copending applications Ser. Nos. 08/372,068, filed Jan. 12, 1995, Rusche, et al.; 08/372,490, filed Jan. 12, 1995, Shaw, et al.; and 08/277,558, filed Jul. 19, 1994, Hartman, et al., incorporated herein by reference.

The invention is examplified by the following non-limiting examples in which all numerical values are approximations consistent with normal experience. The compositions can be made with preheated softener active by adding it to the "water seat" comprising water and minors, but more preferably are made at ambient temperature, especially after premixing the active and perfume.

Preparation of Biodegradable Fabric Softening Actives

One preferred triglyceride source which can be used to prepare the fabric softening compositions herein is canola oil. Canola oil is a mixture of triglycerides having an appropriate chain length distribution and degree of unsaturation of the respective acyl groups. Canola oil is a particularly desirable starting product in accordance with the process of the present invention, for several reasons. In particular, its natural distribution of the chain lengths of the respective acyl groups has a notably high proportion of acyl groups containing 18 carbon atoms, thus avoiding the additional expense incurred when using other commercial sources of $C_{18}$ fatty acids as starting materials.

The triglyceride starting product can be hydrogenated, if desired, to convert diunsaturated and triunsaturated acyl groups, particularly those containing 18 carbon atoms, to their monounsaturated counterparts. It is normally desirable that hydrogenation of mono-unsaturated acyl groups is minimized and even completely avoided. Saturated acyl groups can be obtained from normally saturated sources and mixed with unsaturated acyl groups. In some useful mixtures of acyl groups, no more than about 10% of unsaturated $C_{18}$ acyl groups are hydrogenated to their saturated counterparts. For some products, hydrogenation of diunsaturated and triunsaturated $C_{18}$ acyl groups is preferably maximized, consistent with minimal formation of saturated $C_{18}$ groups. For instance, triunsaturated acyl groups can be completely hydrogenated without achieving complete hydrogenation of diunsaturated acyl groups.

Hydrogenation of the triglyceride starting product which maximizes monounsaturated acyl groups can be readily achieved by maintaining an appropriate balance of the conditions of the hydrogenation reaction. The process variables in the hydrogenation of triglycerides and the effects of altering such variables, are generally quite familiar to those of ordinary skill in this art. In general, hydrogenation of the triglyceride starting product can be carried out at a temperature ranging (broadly stated) between about 170° C. and about 205° C. and more preferably within a somewhat narrower range of about 185° C. to about 195° C. The other significant process variable is the pressure of hydrogen within the hydrogenation reactor. In general, this pressure should be maintained within a range (broadly stated) of about 2 psig to about 20 psig, and more preferably between about 5 psig and about 15 psig.

Within these ranges of parameters, hydrogenation can be carried out with a particular view to the effects of these parameters. Lower hydrogen pressures in the reactor permit a greater degree of control of the reaction, particularly as to its selectivity. By "selectivity" is meant the hydrogenation of diunsaturated and triunsaturated acyl groups without excessive hydrogenation of mono unsaturated acyl groups. On the other hand, higher hydrogen pressures afford less selectivity. Selectivity can be desirable in certain instances.

Higher hydrogenation temperatures are associated with faster rates of hydrogenation and with greater selectivity of the hydrogenation. Conversely, lower hydrogenation temperatures are associated with less selectivity (i.e. increased hydrogenation of the mono unsaturated groups), and particularly with slower hydrogenation rates in general.

These considerations are also balanced with considerations of stereochemistry. More specifically, the presence of unsaturation in the acyl groups can lead to the formation of different stereoisomers in the acyl groups upon hydrogenation. The two possible stereoisomeric configurations for unsaturated fatty acyl groups are known as the "cis" and the "trans" forms. The presence of the cis form is preferred, as it is associated with a lower melting point of the eventual product and thus with greater fluidity. Thus, another reason that canola oil is a particularly preferred triglyceride starting product is that, as a naturally occurring material, the acyl groups present in this triglyceride exhibit only the cis form. In the hydrogenation, higher hydrogen pressures are associated also with a decreased tendency of the acyl group to undergo configuration change from the cis form to the trans form. Also, higher hydrogenation temperatures while favorable for some reasons are also associated with higher conversion of cis unsaturation to the trans form. Products exhibiting satisfactory properties can be obtained by appropriate control of the hydrogenation conditions so as to afford both selectivity and control of the stereochemical configurations of the product.

The hydrogenation is carried out in the presence of a suitable hydrogenation catalyst. Such catalysis are well known and commercially available. They generally comprise nickel, palladium, ruthenium or platinum, typically on a suitable catalyst support. A suitable catalyst is a nickel based catalyst such as sold by Engelhard under the trade designation "N-545".

In one variation, the hydrogenation is carried out to an end point at which hydrogenation of the diunsaturation and triunsaturation in the triglyceride product is maximized, while formation of saturated acyl groups is minimized. The progress of the hydrogenation reaction toward the end point can readily be monitored by periodic measurement of the iodine value of the reaction mass. As the hydrogenation proceeds, the iodine value decreases. For example, the hydrogenation reaction can be discontinued when the iodine value reaches about 95.

Other requirements for hydrogenation reactions are well known, such as the types of reactor, cooling means to maintain the desired temperature, the provision of means for agitation effective to provide adequate contact between the triglyceride and the hydrogen and catalyst, etc.

The triglyceride containing the desired acyl groups is typically hydrolyzed to obtain the desired fatty acyl groups as, e.g., the corresponding fatty acids. That is, the three ester bonds in the triglyceride are broken so that the hydrogenated combination of acyl groups is converted to a mixtures of fatty acids having the same chain length distribution as in the acyl groups, and having the distribution of saturation and unsaturation provided by the hydrogenation reaction. However, other approaches include using transesterification to create, e.g., methyl esters, which then can be used to esterify the alkanolamine, as described hereinafter.

Hydrolysis can be carried out under any of the suitable conditions known in this art for hydrolysis of triglycerides into their fatty acid constituents. In general, the triglyceride is reacted with high temperature steam in a reactor, wherein the fatty acids are split off from glycerine, following which the steam is condensed to form an aqueous solution of glycerine and this solution is removed.

The mixture of fatty acids which is obtained in the hydrolysis step is then used to esterify, e.g., one or more amines of the formula $R—N(CH_2CH_2OH)_2$ wherein R is defined above, and is preferably methyl. Alternatively, the desired esterification can be obtained by transesterification with the corresponding fatty acyl ester like methyl ester.

Esterification can be carried out under conventional esterification conditions, providing an acidic catalyst and providing for withdrawal of by-product water of condensation. Preferably, a small amount, generally up to about 1.0 wt. % of the reactant (i.e. acids and amine), of hypophosphorous acid (HPPA) can be added to the esterification reaction mixture. HPPA is believed to catalyze the reaction and preserve, or even improve the color of the product obtained in this reaction.

In one embodiment of this invention, esterification is allowed to proceed completely such that all amine present is diesterified with fatty acids produced in the previous hydrolysis step. It is, however, sometimes desirable to produce a minor amount of the corresponding monoester as discussed hereinbefore.

The mixture of diesters, or mixture of diester and monoester components, as the case may be, is quaternized. Quaternization is carried out under conditions and with reactants generally familiar to those experienced in this field. The quaternizing agent has the formula RX, wherein R is preferably methyl, benzyl, or ethyl, and X is the anion as defined hereinabove. Preferably RX is methyl chloride, benzyl chloride, dimethyl sulfate, or diethyl sulfate. This quaternization step produces a mixture of biodegradable fabric softening actives as described hereinabove.

It is highly desirable that the compounds used herein are relatively free from unwanted impurities. Therefore, it is desirable to process the fatty acid sources in ways that are known to eliminate such impurities, e.g., processing under atmospheres that are low in oxygen, separating unwanted materials by filtration, adsorption, etc., either before and/or after chemical modification by controlled hydrogenation and/or oxygenation, etc. However, the purity of the materials is not part of the invention herein, which is equally applicable to less pure materials, the trade-off between purity and cost always being adjusted in light of the consumer's desires and needs.

The synthesis of the mixtures of biodegradable fabric softening actives of the present invention is further illustrated in the following Synthesis Examples. These Synthesis Examples are provided for purposes of illustration only.

Compound Synthesis Example A

Approximately 1,300 grams of canola oil and approximately 6.5 grams of a commercial nickel hydrogenation catalyst (Engelhard, "N-545") corresponding to approximately 0.13 wt. % Ni, are placed in a hydrogenation reactor which is equipped with stirrer. The reactor is sealed and evacuated. The contents are heated to about 170° C. and hydrogen is fed into the reactor. Stirring at 450 rpm is maintained throughout the reaction. After about 10 minutes the temperature in the reactor is about 191° C. and the hydrogen pressure is about 11 psig. The temperature is held at about 190° C. After about 127 minutes from when the hydrogen feed began, the hydrogen pressure is about 10 psig. A sample of the reaction mass is drawn and found to have an iodine value of about 78.0 and a cis:trans ratio of about 1.098. After another about 20 minutes at about 190° C., the hydrogen pressure is about 9.8 psig. The hydrogen feed is discontinued and the reactor contents cooled with stirring. The final reaction product has an iodine value of about 74.5 and a cis:trans ratio of about 1.35.

The product that forms in the reactor is removed and filtered. It has a cloud point of about 22.2° C. The chain length distributions of the acyl substituents on the sample taken at about 127 minutes, and of the final product, are determined to be as shown in Table 1 in which "sat." means saturated, and "mono" and "di" means monounsaturated and diunsaturated, respectively.

TABLE 1

| | Approximate Percent (mol.) | |
|---|---|---|
| Chain length | Sample @ 127 min. | Product |
| C14-sat. | 0.1 | 0.1 |
| C16-sat. | 4.7 | 4.6 |
| C16-mono. | 0.4 | 0.4 |
| C18-sat. | 8.9 | 13.25 |
| C18-mono. | 77.0 | 73.8 |
| C18-di. | 4.5 | 3.1 |
| C20-sat. | 0.7 | 0.75 |
| C-20-mono. | 2.1 | 2.0 |
| Other | 1.6 | 2.0 |

Compound Synthesis Example B

About 1,300 grams of canola oil and about 5.2 grams of Engelhard "N-545" nickel hydrogenation catalyst are placed in a hydrogenation reactor which is equipped with a stirrer. The reactor is sealed and evacuated. The contents are heated to about 175° C. and hydrogen is fed into the reactor. Stirring is maintained at about 450 rpm throughout the course of reaction. After about 5 minutes the temperature in the reactor is about 190° C. and the hydrogen pressure is about 7 psig. The temperature is held at about 190° C. After about 125 minutes from the start of the hydrogen feed, the hydrogen pressure is about 7 psig. A sample of the reaction mass is drawn and found to have an iodine value of 85.4. After another about 20 minutes at about 190° C., the hydrogen pressure is about 6 psig. The hydrogen feed is discontinued and the reactor contents cooled with stirring. The final reaction product has an iodine value of about 80.0. The product that forms in the reactor is removed and filtered. It has a cloud point of about 18.6° C.

Synthesis Example C

About 1,300 grams of canola oil and about 2.9 grams of Engelhard "N-545" nickel hydrogenation catalyst are placed in a hydrogenation reactor which is equipped with a stirrer. The reactor is sealed and evacuated. The contents are heated to about 180° C. and hydrogen is fed into the reactor. Stirring is maintained at about 450 rpm throughout the course of the reaction. After about 5 minutes the temperature in the reactor is about 192° C. and the hydrogen pressure is about 10 psig. The temperature is held at about 190°±3° C. After about 105 minutes from the start of the hydrogen feed, the hydrogen pressure is about 10 psig. A sample of the reaction mass is drawn and found to have an iodine value of 85.5. After another about 20 minutes at about 190° C., the hydrogen pressure is about 10 psig. The hydrogen feed is discontinued and the reactor contents cooled with stirring. The final reaction product has an iodine value of about 82.4. The product that forms in the reactor is removed and filtered. It has a cloud point of about 17.2° C.

Compound Synthesis Example D

About 1,300 grams of canola oil and about 1.4 grams of Engelhard "N-545" nickel hydrogenation catalyst are placed in a hydrogenation reactor which is equipped with a stirrer. The reactor is sealed and evacuated. The contents are heated to about 180° C. and hydrogen is fed into the reactor. After 5 minutes the temperature in the reactor is about 191° C. and the hydrogen pressure is about 10 psig. The temperature is held at about 190°±3° C. After about 100 minutes from the start of the hydrogen feed, the hydrogen pressure is about 10 psig. A sample of the reaction mass is drawn and found to have an iodine value of about 95.4. After another about 20 minutes at about 190° C., the hydrogen pressure is about 10 psig. The hydrogen feed is discontinued and the reactor contents cooled with stirring. The final reaction product had an iodine value of about 2.3. The product that forms in the reactor is removed and filtered. It has a cloud point of about 34° C.

Compound Synthesis Example E

About 1,300 grams of canola oil and about 1.3 grams of Engelhard "N-545" nickel hydrogenation catalyst are placed in a hydrogenation reactor which is equipped with a stirrer. The reactor is sealed and evacuated. The contents are heated to about 190° C. and hydrogen is fed into the reactor to a hydrogen pressure of about 5 psig. After about 3 hours from the start of the hydrogen feed, a sample of the reaction mass is drawn and found to have an iodine value of about 98. The hydrogenation is interrupted, another about 0.7 grams of the same catalyst is added, and the reaction conditions are reestablished at about 190° C. for anotherabout 1 hour. The hydrogen feed is then discontinued and the reactor contents cooled with stirring. The final reaction product had an iodine value of about 89.9. The product that forms in the reactor is removed and filtered. It has a cloud point of about 16.0° C.

Compound Synthesis Example F

About 1,300 grams of canola oil and about 2.0 grams of Engelhard "N-545" nickel hydrogenation catalyst are placed in a hydrogenation reactor which is equipped with a stirrer. The reactor is sealed and evacuated. The contents are heated to about 190° C. and hydrogen is fed into the reactor to a hydrogen pressure of about 5 psig. Stirring is maintained at about 420 rpm throughout the course of reaction of the hydrogen feed. After about 130 minutes from the start of the hydrogen feed, the hydrogen feed is discontinued and the reactor contents cooled with stirring. The final reaction product had an iodine value of about 96.4. The product that forms in the reactor is removed and filtered. It has a cloud point of about 11.2° C.

Compound Synthesis Example G

A mixture of about 1,200 grams of the hydrogenated oil from Synthesis Example F and about 200 grams of the hydrogenated oil from Synthesis Example A is hydrolyzed three times with about 250° C. steam at about 600 psig for about 2.5 hours at a ratio of steam:oil of about 1.2 (by weight). An aqueous solution containing the glycerine which had split off is removed.

The resulting mixture of fatty acids is vacuum distilled for a total of about 150 minutes, in which the pot temperature rose gradually from about 200° C. to about 238° C. and the head temperature rose gradually from about 175° C. to about 197° C. Vacuum of about 0.3–0.6 mm is maintained.

The fatty acids product of the vacuum distillation has an iodine value of about 99.1, an amine value (AV) of about 197.6 and a saponification value (SAP) of about 198.6.

Compound Synthesis Example H

About 800 grams of mixture of fatty acids obtained from canola oil by the foregoing procedures, about 194.4 grams of MDEA (methyl diethanolamine) about 2 grams of BHT (butylated hydroxytoluene), and about 1 gram of an approximately 50 wt. % aqueous solution of HPPA are placed in a pot at the bottom of a distillation column. Nitrogen flow through the column is established. The pot is heated, and distillation began at a pot temperature of about 150° C., and a head temperature of about 102° C. The mixture temperature rose to about 193° C. in the first hour and then gradually rose to about 202° C. through the next about 4 hours. The head temperature rose to about 107° C. in the first hour and then declined gradually to about 62° C. over the next about 4 hours. The product in the pot is then cooled, recovered and analyzed. The distillate contained about 3 wt. % MDEA, about 51 grams of water, and exhibited a total amine value (TAV) of about 0.5. The product remaining in the pot has a total amine value (TAV) of about 93.3.

Compound Synthesis Example I

About 900 grams of the product of Synthesis Example H, about 158 grams of ethanol, about 0.3 grams of ADPA, 1-hydroxyethane-1,1-diphosphonic acid (a chelant, for color), about 0.15 grams of antifoam, and sufficient methyl chloride to establish an initial pressure of about 43 psig are combined in a sealed reactor. After about 7 minutes the temperature is about 106° C. and the pressure is about 84 psig. The contents are then maintained at about 105°±1° C. for about 3–5 hours while the pressure is maintained at about 57±2 psig by additions of methyl chloride. Then the reactor is vented, and the contents cooled to about 95° C. A total of about 110 grams of methyl chloride is used. The product is then removed and stripped at about 65° C. on a rotary evaporator. The product has a diester content of about 75.9% and a monoester content of about 11.4%.

EXAMPLES 1 TO 4

| Ingredients | Ex. 1 Wt. % | Ex. 2 Wt. % | Ex. 3 Wt. % | Ex. 4 Wt. % |
|---|---|---|---|---|
| DEQA[1] (85% active in ethanol) | 17.7 | 23.5 | 30.6 | 30.6 |
| Perfume | 0.8 | 1 | 1.35 | — |
| Tenox 6 | 0.02 | 0.03 | 0.04 | 0.04 |
| $CaCl_2$ (25% solution) | 1.2 | 1.5 | 2 | 2 |
| HCl 1N | 0.17 | 0.23 | 0.30 | 0.30 |
| Distilled Water | Balance | Balance | Balance | Balance |

Examples 1 to 3—Process

The compositions of Examples 1–3 are made at ambient temperature by the following process:

1. Prepare the water seat containing HCl.
2. Separately, mix perfume and Tenox antioxidant to the diester softener active.
3. Add the diester active blend into the water seat with mixing.
4. Add about 10–20% of the $CaCl_2$ solution at approximately halfway through the diester addition.
5. Add the remainder of the $CaCl_2$ solution after the diester addition is complete with mixing.

| Ingredients | Ex. 1 Wt. % | Ex. 2 Wt. % | Ex. 3 Wt. % | Ex. 4 Wt. % |
|---|---|---|---|---|
| DEQA[5] (85% active in ethanol) | 17.7 | 23.5 | 30.6 | 30.6 |
| Perfume | 0.8 | 1 | 1.35 | — |
| Tenox 6 | 0.02 | 0.03 | 0.04 | 0.04 |
| $CaCl_2$ (25% solution) | 1.2 | 1.5 | 2 | 2 |
| HCl 1N | 0.17 | 0.23 | 0.30 | 0.30 |
| Distilled Water | Balance | Balance | Balance | Balance |

Examples 4 to 6—Process

The compositions of Examples 5 to 8 are made similar to those of Examples 1 to 4, except that DEQA[5] is used instead of DEQA[1].

The compositions of Examples 1 to 8 have good viscosity. They are frozen when placed in a constant temperature room for about 3 days at a temperature of about 0° F. (about −18° C.). After thawing at ambient temperature, these compositions recover as fluid and have good viscosity.

Comparative Examples 9 to 12

The compositions of Comparative Examples 9 to 12 are made similar to those of Examples 1 to 4, with the exception that (a) DEQA[11] (prepared from a slightly hydrogenated tallow fatty acid) is used instead of DEQA[1], (b) softener active needs to be heated to melt at about 75° C. before it is added to the water seat, also preheated to about 75° C., (c) about 50% more $CaCl_2$ is needed to provide good product viscosity, and (d) perfume is added last, to the cooled finished composition to avoid perfume degradation. The compositions of Examples 9 to 12 have good viscosity when they are cooled after preparation to room temperature. However, after being frozen when placed in a constant temperature room for about 3 days at a temperature of about 0° F. (about −1 8° C.) and then thawed at ambient temperature, these compositions do not recover and still remain thickened or have lumpy consistency.

EXAMPLES 13 AND 14

| Ingredients | Example 13 Wt. % | Example 14 Wt. % |
|---|---|---|
| DEQA[8] (85% active in ethanol) | 30.6 | — |
| DEQA[9] (85% active in ethanol) | — | 30.6 |
| Perfume | 1.35 | 1.35 |
| Tenox 6 | 0.04 | 0.04 |
| $CaCl_2$ (25% solution) | 2 | 2 |
| HCl 1N | 0.30 | 0.30 |
| Distilled Water | Balance | Balance |

Examples 13 and 14

The compositions of Examples 13 and 14 are made similar to that of Example 3, except that DEQA[8] and DEQA[9] are used instead of DEQA[1].

EXAMPLES 15 TO 19

| Ingredients | Ex. 15 Wt. % | Ex. 16 Wt. % |
|---|---|---|
| DEQA[10] (85% active in ethanol) | 20.8 | — |
| DEQA[11] (85% active in ethanol) | | 20.8 |
| Perfume | 1.35 | 1.35 |
| Tenox 6 | 0.04 | 0.04 |
| $CaCl_2$ (25% solution) | 2 | 2 |
| HCl 1N | 0.30 | 0.30 |
| Distilled Water | Bal. | Bal. |

What is claimed is:

1. Concentrated aqueous liquid fabric softener composition comprising:

(A) from about 15% to about 50% of biodegradable softener active selected from the group consisting of:

1. softener having the formula:

$$[(R)_{4-m}-N^{(+)}-[(CH_2)_n-Y-R^1]_m]X^{(-)} \quad (1)$$

wherein each R substituent is a short chain $C_1$–$C_6$ alkyl or hydroxyalkyl group, benzyl, or mixtures thereof; each m is 2 or 3; each n is from 1 to about 4; each Y is —O—(O)C—, or —C(O)—O—each $R^1$ is a hydrocarbyl, or substituted hydrocarbyl, group, the sum of carbons in each $R^1$, plus one when Y is —O—(O)C—, being $C_{12}$–$C_{22}$; the average Iodine Value of the parent fatty acid of the $R^1$ group being from about 80 to about 140; and wherein the counterion, $X^-$ is any softener-compatible anion;

softener having the formula:

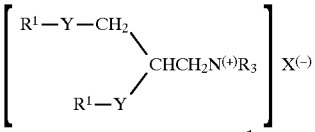

(2)

wherein each Y, R, $R^1$, and $X^{(-)}$ have the same meanings as before; and 3. mixtures thereof;

(B) optionally, from about 0% to about 10% of perfume;

(C) optionally, from about 0% to about 2% of stabilizer; and (D) the balance being a liquid carrier comprising water and optional low molecular weight alcohol, the composition having a viscosity of less than about 1000 cps after freezing and thawing.

2. The composition of claim 1 comprising from about 16% to about 35% of softener active selected from the group consisting of:

(1) softener active having the formula:

$$[(R)_{4-m}-N^{(+)}-[(CH_2)_n-Y-R^1]_m]X^{(-)} \quad (1)$$

wherein each R substituent is a $C_1$–$C_3$ alkyl or hydroxyalkyl group, or mixtures thereof; each m is 2 or 3; each n is from 1 to about 4; each Y is —O—(O)C—; each $R^1$ is a long chain $C_{13}$–$C_{19}$ hydrocarbyl, or substituted hydrocarbyl, substituent, the IV of the parent fatty acid of this $R^1$ group being from about 80 to about 130; and wherein the counterion, $X^-$is chloride;

2. softener active having the formula:

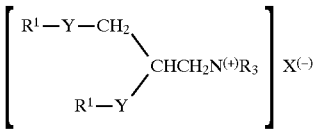

(2)

wherein each Y, R, $R^1$, and $X^{(-)}$ have the same meanings as before; and 3. mixtures thereof.

3. The composition of claim 2 wherein the softener active has the formula:

$$[(R)_{4-m}-N^{(+)}-[(CH_2)_n-Y-R^1]_m]X^{(-)} \quad (1)$$

wherein each R substituent is a $C_1$–$C_3$ alkyl or hydroxyalkyl group, benzyl, or mixtures thereof, each m is 2; each n is from 1 to about 4; and the IV of the parent fatty acid of the $R^1$ group is from about 80 to about 115.

4. The composition according to claim 1 wherein the cis/trans isomer weight ratio in said active is from about 1:1 to about 50:1.

5. The composition according to claim 4 wherein the cis/trans isomer weight ratio in said active is from about 3:1 to about 30:1.

6. The composition according to claim 1 wherein the softener active which additionally comprises up to about 20% of monoester compound in which m is 2 and one $YR^1$ is H or —C(O)OH.

7. The process of making the composition of claim 1 wherein the softener active is mixed with the water at ambient temperature.

8. The process of claim 7 wherein the perfume is blended with the softener active before the softener active is added to the water.

9. The process of treating fabrics with the composition prepared according to the process of claim 8.

* * * * *